US009061813B2

(12) United States Patent
Steininger

(10) Patent No.: US 9,061,813 B2
(45) Date of Patent: Jun. 23, 2015

(54) LIQUID METERING ASSEMBLY

(71) Applicant: Zak Designs, Inc., Spokane, WA (US)

(72) Inventor: Jeff Steininger, St. Mary's, OH (US)

(73) Assignee: ZAK DESIGNS, INC., Spokane, WA (US)

( * ) Notice: Subject to any disclaimer, the term of this patent is extended or adjusted under 35 U.S.C. 154(b) by 238 days.

(21) Appl. No.: 13/888,481

(22) Filed: May 7, 2013

(65) Prior Publication Data

US 2014/0001212 A1 Jan. 2, 2014

Related U.S. Application Data

(63) Continuation-in-part of application No. 13/536,587, filed on Jun. 28, 2012, now Pat. No. 8,678,228.

(51) Int. Cl.

| | |
|---|---|
| ***A61J 9/00*** | (2006.01) |
| ***B65D 83/00*** | (2006.01) |
| ***B65D 47/20*** | (2006.01) |

(52) U.S. Cl.

CPC ..... *B65D 83/0055* (2013.01); *B65D 47/2043* (2013.01)

(58) Field of Classification Search

USPC ..... 220/703, 705–709, 714, 715, 717, 719, 220/360, 361, 203.06, 203.07, 253, 254.3, 220/203.04, 203.18, 203.19; 215/11.4, 215/11.5, 11.6, 11.1, 387, 388, 389; 222/531, 532

See application file for complete search history.

(56) References Cited

U.S. PATENT DOCUMENTS

| | | | | |
|---|---|---|---|---|
| 3,211,315 | A * | 10/1965 | Griesinger | 215/11.1 |
| 3,337,098 | A * | 8/1967 | Johns | 222/505 |
| 5,150,800 | A * | 9/1992 | Sarter et al. | 215/11.4 |
| 5,150,815 | A * | 9/1992 | Saklad | 220/708 |
| 5,259,538 | A * | 11/1993 | Tardif | 222/528 |
| 5,361,934 | A * | 11/1994 | Spence, Jr. | 220/707 |
| 5,509,551 | A * | 4/1996 | Terrell, II | 215/229 |
| 5,518,142 | A * | 5/1996 | Lin | 220/707 |
| 5,938,053 | A * | 8/1999 | Verbovszky et al. | 215/6 |
| 6,523,711 | B1 * | 2/2003 | Hughes et al. | 220/709 |
| 7,124,907 | B2 * | 10/2006 | Conaway | 220/254.1 |
| D636,634 | S * | 4/2011 | Kemper et al. | D7/396.2 |
| D666,874 | S * | 9/2012 | Sakulsacha | D7/510 |
| 8,333,299 | B2 | 12/2012 | Kemper et al. | |
| D683,189 | S * | 5/2013 | Thomas | D7/511 |
| 8,528,756 | B2 * | 9/2013 | Itzek et al. | 215/11.4 |
| 8,678,228 | B2 * | 3/2014 | Steininger | 220/703 |
| 2002/0121525 | A1 * | 9/2002 | Stillinger et al. | 220/705 |
| 2009/0255944 | A1 * | 10/2009 | Yamashita et al. | 220/705 |
| 2010/0170902 | A1 * | 7/2010 | Britto et al. | 220/367.1 |
| 2010/0294764 | A1 * | 11/2010 | Kemper et al. | 220/203.18 |
| 2011/0049169 | A1 * | 3/2011 | Rosnak et al. | 220/705 |
| 2011/0062170 | A1 * | 3/2011 | Kemper et al. | 220/708 |
| 2012/0031917 | A1 * | 2/2012 | Loging | 220/705 |

(Continued)

*Primary Examiner* — Bryon Gehman
*Assistant Examiner* — Gideon Weinerth
(74) *Attorney, Agent, or Firm* — Paine Hamblen, LLP

(57) ABSTRACT

A liquid metering assembly is described and which includes a container for enclosing a source of liquid to be dispensed, a container cap defining a dispensing aperture, and a vent aperture, and which is releasably affixed to container; a movable diaphragm releasably cooperating with the container cap, and coupled in fluid flowing relation relative to the dispensing aperture; and a movable liquid volume control member which cooperates with the movable diaphragm, and which further allows a user to withdraw a given volume of liquid from the beverage container.

20 Claims, 7 Drawing Sheets

(56) References Cited

U.S. PATENT DOCUMENTS

2012/0160851 A1* 6/2012 Chiang ..... 220/360
2014/0069944 A1* 3/2014 Shapiro et al. ..... 220/709
2014/0252013 A1* 9/2014 Coyle et al. ..... 220/714
2014/0305945 A1* 10/2014 Chan et al. ..... 220/361

* cited by examiner

LIQUID METERING ASSEMBLY

RELATED PATENT DATA

The present patent application is a Continuation-In-Part patent application which claims priority from U.S. patent application Ser. No. 13/536,587, and which was filed on Jun. 28, 2012.

TECHNICAL FIELD

The present invention relates to a liquid metering assembly, and more specifically to a liquid metering assembly which finds usefulness when incorporated into the structure of a removable lid that is employed with a beverage container, and wherein the liquid metering assembly substantially prevents the removal or withdrawal of liquid from the beverage container when the beverage container is not in use, or is accidentally overturned.

BACKGROUND OF THE INVENTION

Various removable lids for sealing liquid storage, and other beverage containers are well known. In particular variously designed lids have drinking apertures which allow for the selective removal of a beverage contained within the beverage container have been utilized throughout recorded history. With regards to drinking vessels which may be utilized by infants, young children, invalids, and the like, much effort has been directed towards the development of beverage container lids which allows the infant, young child, or other person to sip or otherwise withdraw liquid from the container in a given, measured amount, and further substantially prohibits the spilling of the liquid from the container in the event that the user, such as a child for example, inadvertently overturns the drinking vessel during their dally activities.

The prior art is replete with numerous examples of various arrangements utilized to prevent fluid leakage from the caps which are refeasahly affixed to a beverage container. Perhaps the most germane art which is currently available, and which is directed to solving the problem concerning the development of a spillproof beverage is found in U.S. Pat. No. 8,403,164 and which issued on Mar. 26, 2013. This reference discloses a cap or closure member for a spillproof beverage container which includes a demand valve which is incorporated into the cap, and which, when rendered operational, allows for the selective dispensing of a liquid from the beverage container when an infant, small child, or other individual applies a suction force to the described drinking spout in this arrangement and when suction is not being applied to the drinking spout, the demand valve substantially prohibits the release of the fluid from the beverage container so as to prevent splits if the container is accidentally overturned.

While the aforementioned, and other devices, which are disclosed in the art have worked with varying degrees of success, shortcomings in their individual designs have detracted from their usefulness. For example, in training small children to feed themselves, parents have often found it useful to utilize various assemblies which can be readily adjusted so as to meter selective amounts of fluid to the child so that choking and spilling of the fluid is substantially avoided. While some devices have been developed to allow for the selective dispensing of fluid from a beverage container, as a general matter, it is fair to say that these same devices have typically been complex in their over design, often cumbersome or impossible to clean, and have not typically, and reliably prevented the spilling of liquid in the event that the beverage container is accidentally overturned by the infant or other user during their day-to-day activities. Further, and while the aforementioned prior art patent provides a means by which the flow of a liquid from a beverage container can be turned on and off, this particular design is, however, completely devoid of any features which provides an effective means by which the volume of the liquid released through the valve may be selectively controlled by the user.

In my earlier U.S. patent application Ser. No. 13/536,587 and which was filed on Jun. 28, 2012, I disclosed a novel design for a liquid metering assembly which addressed many of the shortcomings attendant with the prior art designs utilized heretofore. In particular, this reference discloses a liquid metering assembly which is adjustable by the user in order to control the relative volume of the liquid being delivered to the drinking spout of the cap employing same. Further, and while this assembly, as disclosed, in my pending patent application works with a large degree of success, this same drinking cap arrangement often cannot be successfully employed in, or utilized in certain environments, or during some daily activities, as effectively as might be otherwise desired.

Therefore, a liquid metering assembly which overcomes the prior art deficiencies noted above, is the subject matter of the present invention.

SUMMARY OF INVENTION

A first aspect of the present invention relates to a liquid metering assembly which includes a container enclosing a source of a liquid to be dispensed; a container cap for engaging, and enclosing, the source of the fluid within the container, and wherein the container cap defines a dispensing aperture, and a vent aperture; a moveable diaphragm releasably cooperating with the container cap, and coupled in fluid flowing relation relative to the dispensing aperture, and wherein the moveable diaphragm further has a valve member; and a moveable liquid volume control member which sealably, matingly cooperates with the moveable diaphragm, and which further defines a liquid receiving chamber, and a fluid flowing aperture which extends therethrough, and wherein the valve member is received in the fluid flowing aperture, and is moveable relative thereto when a suction is applied to the dispensing aperture of the container cap, and wherein a selective movement of the liquid volume control member relative to the moveable diaphragm varies a volume of the liquid which is dispensed from the container when a given amount of suction is applied to the dispensing aperture.

Still another aspect of the present invention relates to a liquid metering assembly which includes a container enclosing a source of a liquid to be dispensed; a container cap for releasably engaging, and enclosing, the source of the liquid within the container, and wherein the container has a top and bottom surface, and wherein a cavity is formed in the top surface, and the container cap defines a first liquid dispensing aperture, and a vent aperture; a moveable cover which is matingly coupled to the container cap, and which defines a second liquid dispensing aperture which can be adjustably positioned so as to be aligned with the first liquid dispensing aperture; a moveable diaphragm releasably cooperating with the container cap, and which has a flexible liquid dispensing conduit, which extends through each of the aligned first, and second liquid dispensing apertures, and a moveable valve member; and a moveable liquid volume control member which sealably, and matingly cooperates with the moveable diaphragm, and which further defines a liquid receiving chamber, and wherein the flexible liquid dispensing conduit is coupled in fluid flowing relation relative to the liquid receiving chamber, and wherein the moveable liquid volume control member has a fluid flowing aperture formed therein, and wherein the valve member of the moveable diaphragm is received in the fluid flowing aperture, and is moveable relative thereto when a suction is applied to the flexible liquid dispensing conduit, and wherein a selective movement of the liquid volume control member relative to the moveable diaphragm varies a volume of the liquid which is dispensed from the container when a given amount of suction is applied to the flexible liquid dispensing conduit.

Another aspect of the present invention relates to a liquid metering assembly which includes a container for enclosing a source of a liquid to be dispensed, and wherein the container defines an internal cavity for enclosing the liquid, and further has a neck portion which communicates with the infernal cavity; a container cap for releasably engaging the neck portion of the container, and which further has a top surface which defines, at least in part, a semi-circular shaped cavity, and a bottom surface, and wherein the top surface further has formed therein a centrally disposed coupling passageway which extends therethrough, a vent aperture, and a first, liquid dispensing aperture which communicates with the semi-circular shaped cavity formed in the top surface of the container cap, and wherein the bottom surface of the container cap defines a first cavity which releasably and matingly receives and cooperates with the neck of the container, and further defines a reduced dimensioned, second cavity which is defined by a downwardly depending sidewall which is mounted on the bottom surface of the container cap, and wherein the first liquid dispensing aperture communicates with the second cavity, and the vent aperture communicates with the first cavity; a moveable cover having top and bottom surfaces, and which is conformably shaped to matingly and rotatably cooperate with the container cap, and wherein the moveable cover further has a second liquid dispensing aperture formed therein, and which is further moveable along a given course of travel between a first and a second position, and wherein the moveable cover has an engagement member mounted on the bottom surface thereof, and which is dimensioned to be operably received within the coupling passageway, and which renders the moveable cover rotatable relative to the container cap; a moveable diaphragm mounted, at least in part, within the second cavity of the container cap, and wherein the moveable diaphragm defines an internal cavity, and further includes a moveable valve member which is mounted on the diaphragm, and which further depends downwardly therefrom; a flexible liquid dispensing conduit made integral with the moveable diaphragm, and having a first end which communicates in fluid receiving relation relative to the internal cavity of the moveable diaphragm, and a second end, and wherein the flexible liquid dispensing conduit extends through the first and second liquid dispensing apertures, when they are aligned, and the moveable cover is in the first position; and a moveable liquid volume control member which sealably and matingly cooperates with the moveable diaphragm, and is received, at least in part, within the internal cavity thereof, and which further defines a liquid receiving chamber which has a fluid flowing aperture formed therein, and a multiplicity of fluid flowing channels which have different dimensions, and wherein the first end of the flexible liquid dispensing conduit is coupled in fluid receiving relation relative to the liquid receiving chamber, and wherein the valve member is operably received within the fluid flowing aperture defined by the liquid volume control member, and is further moveable relative thereto from a first occluding position, to a second, displaced, and fluid flowing position, and wherein movement to the second non-occluding position is effected by the application of a suction force which is imparted to the second end of the flexible liquid dispensing conduit by means of a mouth of a person, and which then permits the source of the liquid which is enclosed within the container to pass into the liquid receiving chamber, and then be received into the flexible liquid dispensing conduit.

These and other aspects of the present invention will be discussed in greater detail hereinafter.

BRIEF DESCRIPTION OF THE DRAWINGS

Preferred embodiments of the present invention are described, below, with reference to the following accompanying drawings.

DETAILED DESCRIPTION OF THE PREFERRED EMBODIMENTS

This disclosure of the invention is submitted in furtherance of the constitutional purposes of the U.S. Patent laws "to promote the progress of science and useful arts." (Article I, Section 8).

Figure 1:
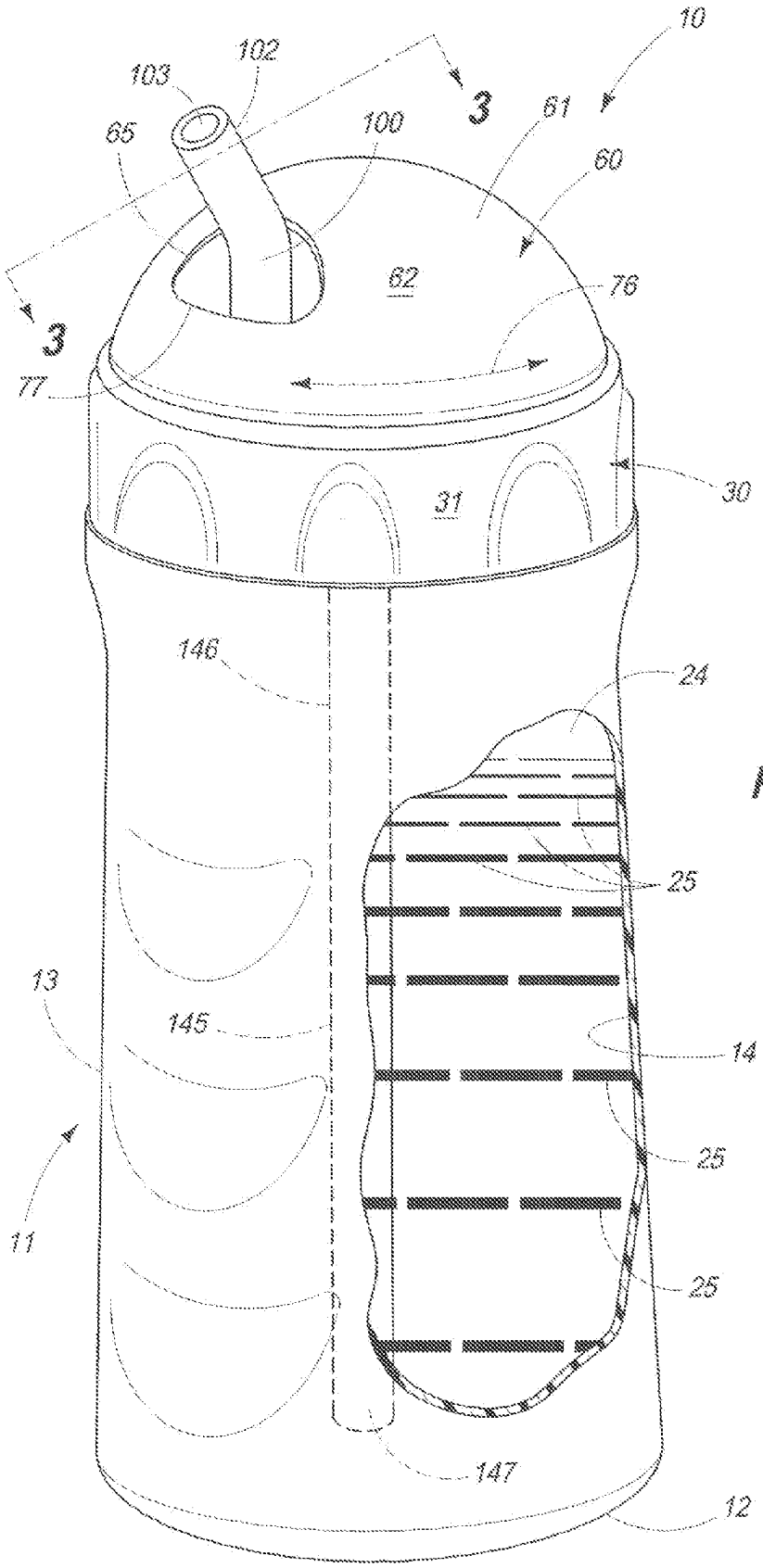
FIG. 1 is a perspective, side elevation view of the liquid metering assembly of the present invention, and which is shown in a typical operational environment where a person employing same (not shown) may gain access to the beverage or other liquid which is enclosed within same.
Figure 2:
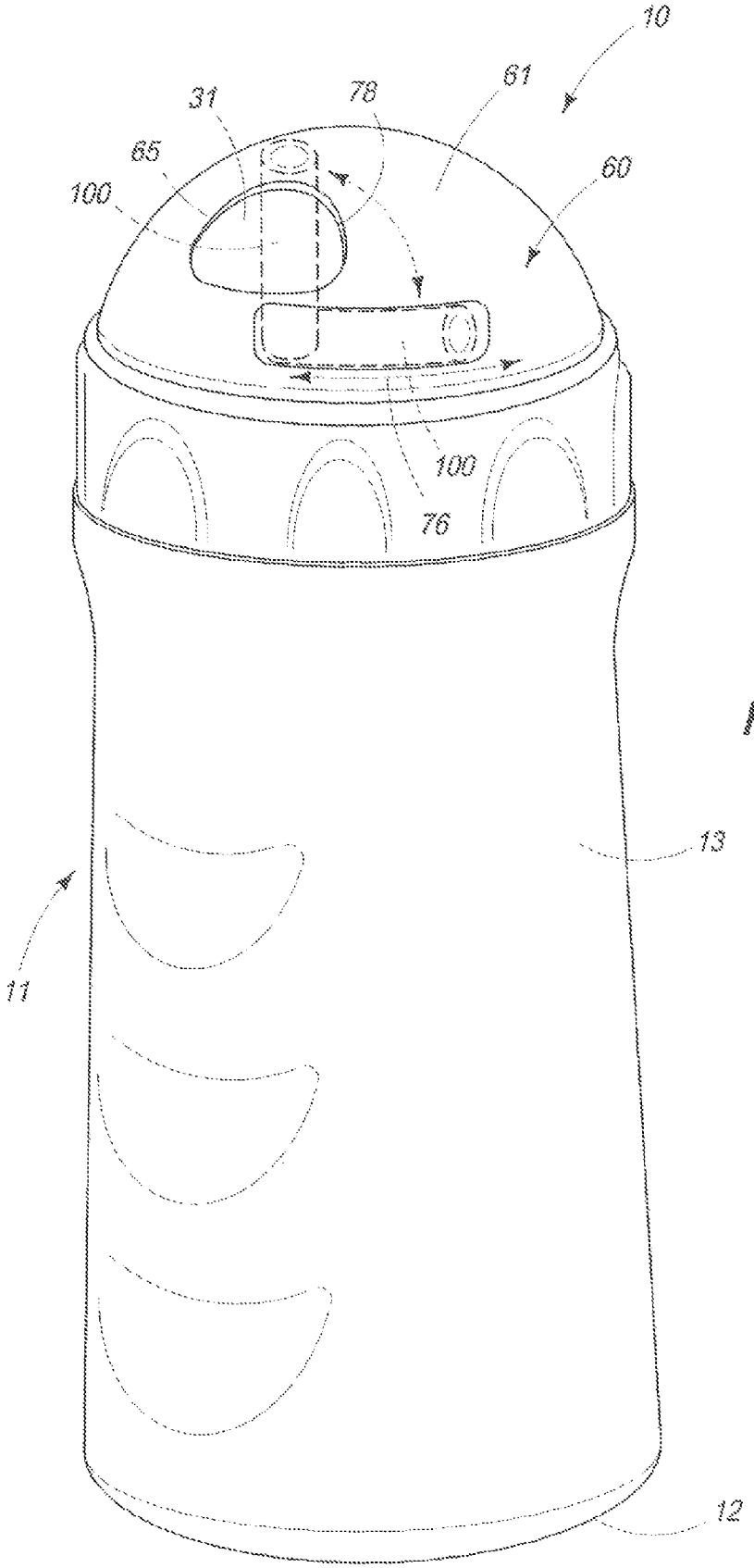
FIG. 2 is a second, perspective, side elevation view of the liquid metering assembly of the present invention, and which is shown in a typical operating environment, and which is further configured so that no access can be gained to the beverage enclosed within the beverage container.

A liquid metering assembly of the present invention is generally indicated by the numeral 10 in FIG. 1, and following. The liquid metering assembly 10 is useful when used in combination with a beverage container of substantially conventional design, and which is indicated by the numeral 11, and which further can be releasably secured in fluid delivering relation relative thereto. In particular, the beverage container 11 as seen in FIGS. 1 and 2, respectively, includes a bottom surface 12, which is operable to support the beverage container on an underlying supporting surface, not shown. The beverage container 11 further has a substantially continuous sidewall 13 which is sealably mounted, or made integral with, the bottom surface, and which further extends upwardly therefrom. The continuous sidewall 13 has an inside facing surface 14. Further, the continuous sidewall has an upper neck portion which is generally indicated by the numeral 15. The upper neck portion 15 is defined, at least in part, by a threaded exterior portion [best seen in FIG. 3] and which is operable to threadably, and releasably mate with a container cap which will be described in greater detail, hereinafter. The neck portion 15 further has an inside facing surface 21 which defines a neck passageway 22 [FIG. 3] having a given cross sectional dimension. Still further, the neck passageway 22 is defined, in part, by a top peripheral edge 23. The inside facing surface 21, of the continuous sidewall 13, defines an internal cavity 24 [FIG. 1] which is operable to enclose a source of the liquid to be consumed, or dispensed, and which is generally indicated by the numeral 25 [FIG. 1].

Figure 4:
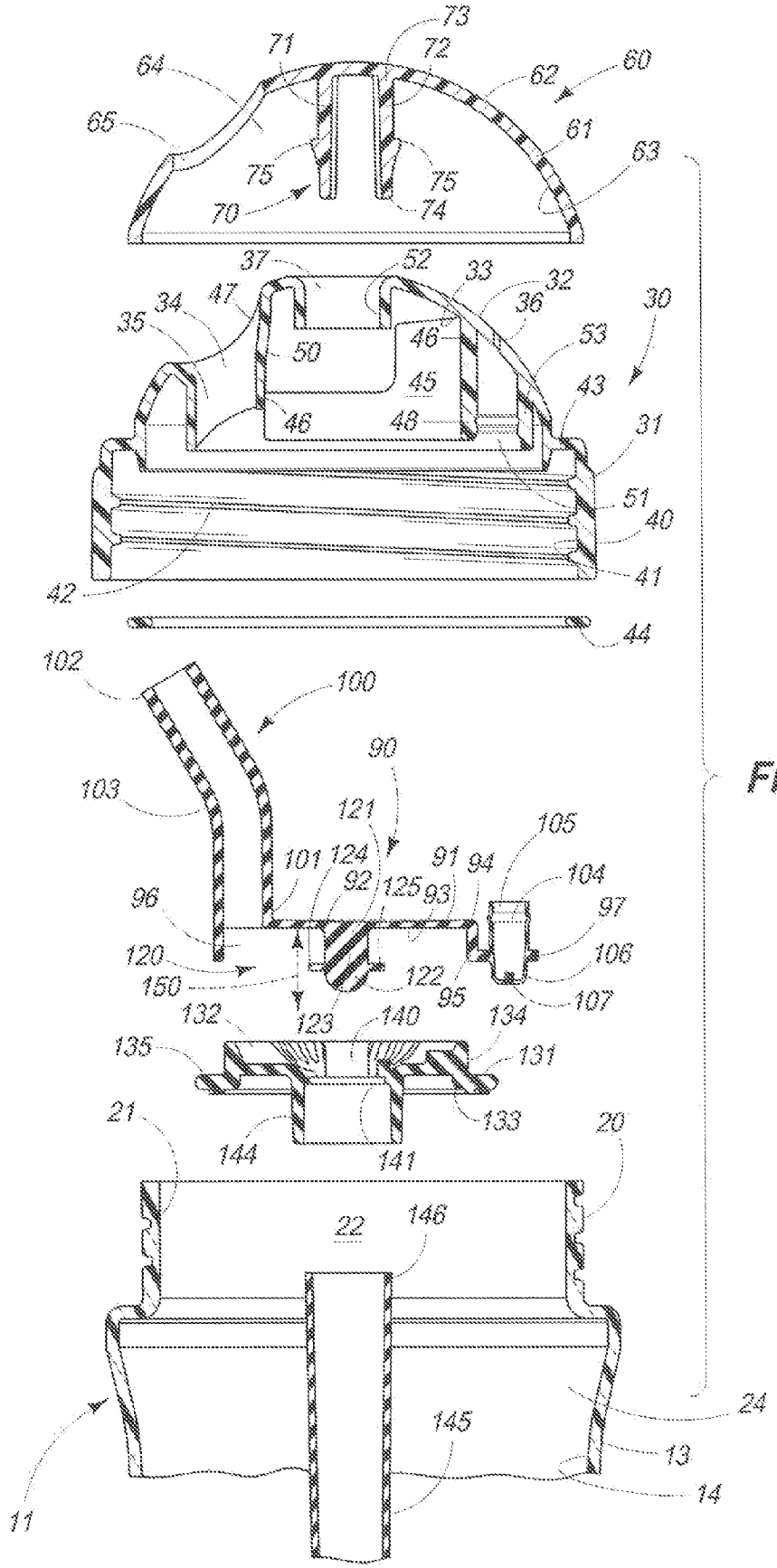
FIG. 4 is an exploded, transverse, vertical sectional view of the liquid metering assembly of the present invention.
Figure 6:
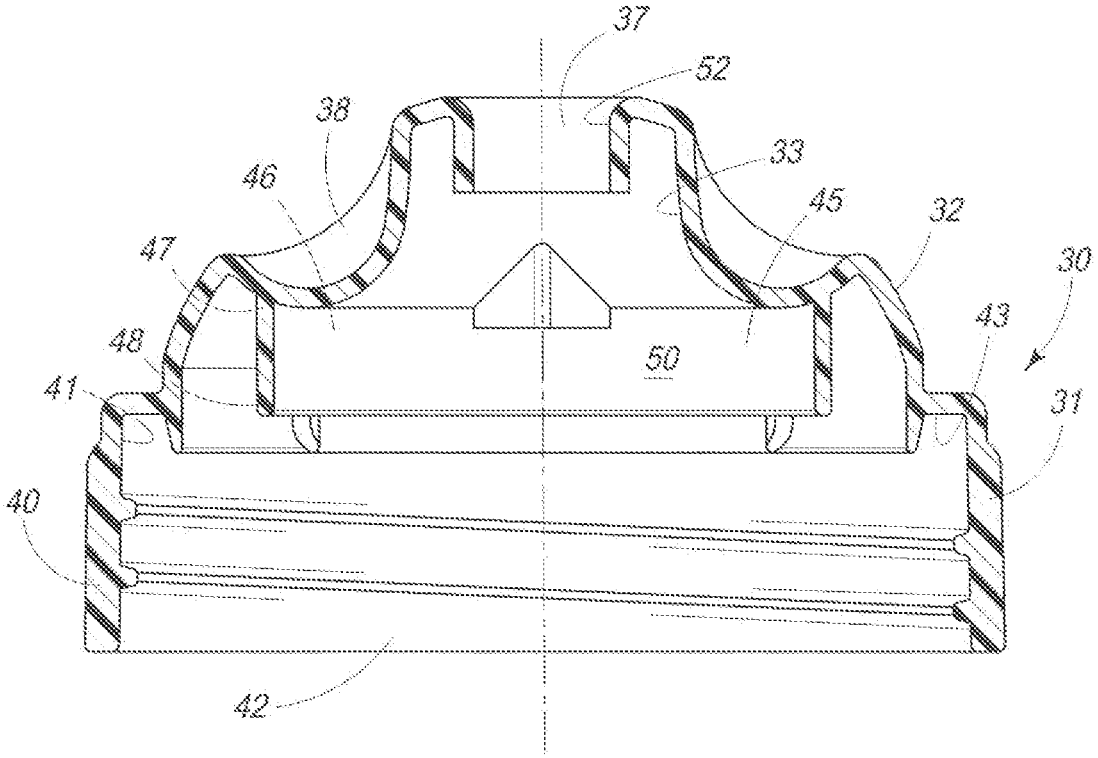
FIG. 6 is a transverse, vertical sectional view of the container cap which finds usefulness in the present invention.
Figure 7:
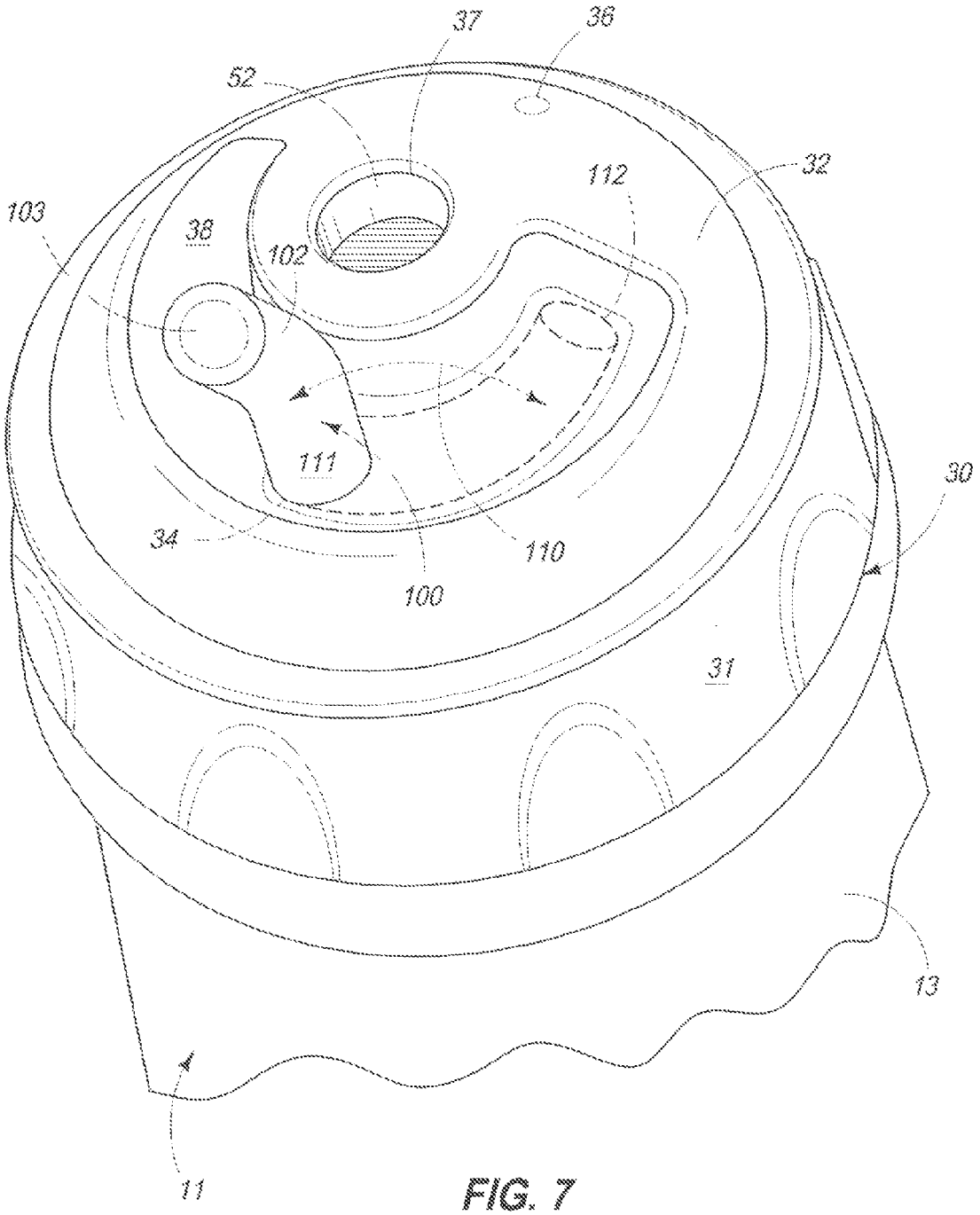
FIG. 7 is a perspective, top, plan view of the container cap which finds usefulness in the present invention.

A container or drinking cap which is generally indicated by the numeral 30 is provided, and which is releasably engagable with the neck portion 15, as earlier described [FIGS. 4 and 6]. The drinking cap, which is seen in the cross section in FIGS. 2 and 4, has a main body 31 having an outside facing or top facing surface 32, and an inside or bottom facing surface 33. The outside facing surface defines a first liquid dispensing aperture 34 [FIG. 4], and which extends through the top and bottom surfaces 32 and 33, and is further defined by a channel which is identified by the numeral 35. Additionally, a vent aperture 36 is formed therein, and is operable to couple a surrounding ambient environment with the internal cavity 24 as defined by the beverage container 11. Additionally, and as seen in FIG. 7, the top or outside facing surface 32 has formed substantially centrally thereof a generally centrally disposed coupling passageway 37 which extends through the top and bottom surfaces 32 and 33, and which further is operable to cooperate with a moveable cover which will be discussed in greater detail, hereinafter. Additionally, the outside facing, or top surface 32, defines a semi-circular shaped cavity 38 which is operable to receive a flexible liquid dispensing conduit as will be described, hereinafter [FIGS. 8 and 7]. As seen in FIG. 7, the first liquid dispensing aperture 34 is located within and approximately midway along the semi-circular shaped cavity 38 which is formed in the top surface 32.

As best seen in the drawings, [FIG. 6] the container or drinking cap 30 has an inside threaded sidewall portion 40 which is defined, at least in part, by an inside facing surface 41. The threaded sidewall portion 40 is arranged so as to conveniently, and threadably mate with the threaded, exterior portion 20, as defined by the upper neck portion 15 of the beverage container 11. The inside threaded sidewall 40 defines a first cavity 42, which receives and cooperates, at least in part, with a portion of the neck 15 of the beverage container 11. As seen in the drawing, the first cavity 42 further defines a substantially circular-shaped channel 43. The channel 43 is operable to receive a resilient, elastomeric O-ring seal 44 therein [FIG. 4], and in a manner which is well known in the art. Still further, a reduced dimensioned second cavity 45, communicates with the first cavity 43, and is further defined by a downwardly depending sidewall 46 [FIGS. 4 and 6]. This downwardly depending sidewall 46 has a first end 47, which is mounted on, or made integral with, the bottom or inside facing surface 33 of the container or drinking cap 30. Further, the downwardly depending sidewall 46 has an opposite second end 48. The second end 48 provides a means for forcibly engaging and otherwise releasably capturing and positioning in the manner of a friction-fit, a moveable diaphragm, and a liquid volume control member in an appropriate operational orientation relative to the reduced dimensioned second cavity 45, as will be discussed in greater detail, hereinafter. The downwardly depending sidewall 46, has an inside facing surface 50 which is generally cylindrical, or circular in shape. The downwardly depending sidewall further defines, at least in part, a radially extending space 51 as seen in FIG. 4. The first liquid dispensing aperture 34, and the vent aperture 36 communicate, on the one hand, with the reduced dimensioned second cavity 45; and the vent aperture 36, when assembled, communicates with the first cavity 42 in the manner which will be described in greater detail, hereinafter. Additionally, it will be seen from the drawings that an inwardly extending sidewall 52, is provided, and which defines the centrally disposed coupling passageway 37. Further, and yet another depending sidewall 53 is provided [FIG. 4], and which defines, in part, a channel, or passageway, which couples the vent aperture 36, with the first cavity 42, in the manner which will be described, below.

Figure 3:
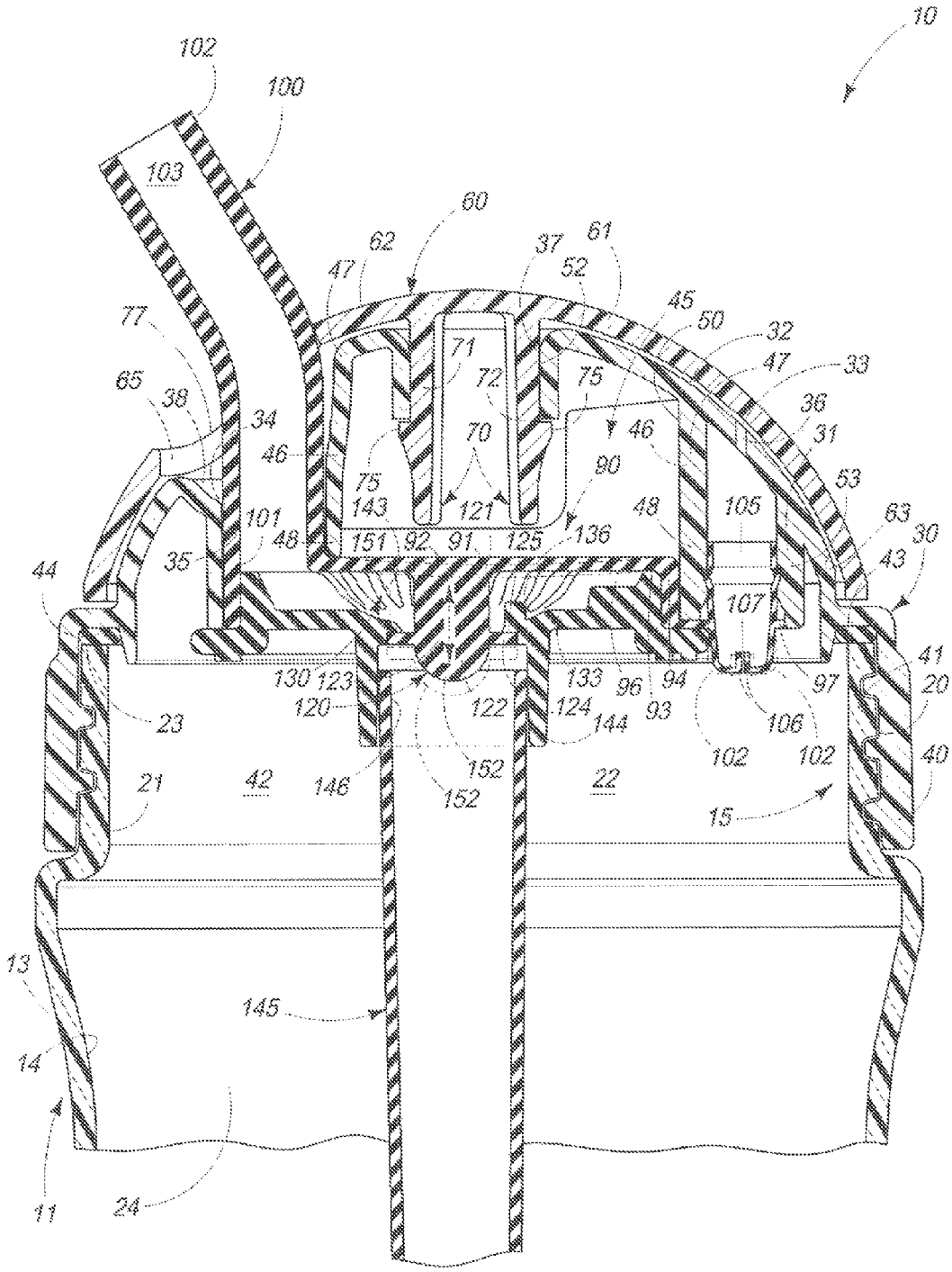
FIG. 3 is a partial, transverse, vertical sectional view and which is taken from a position along the line labeled 3-3 of FIG. 1.
Figure 5:
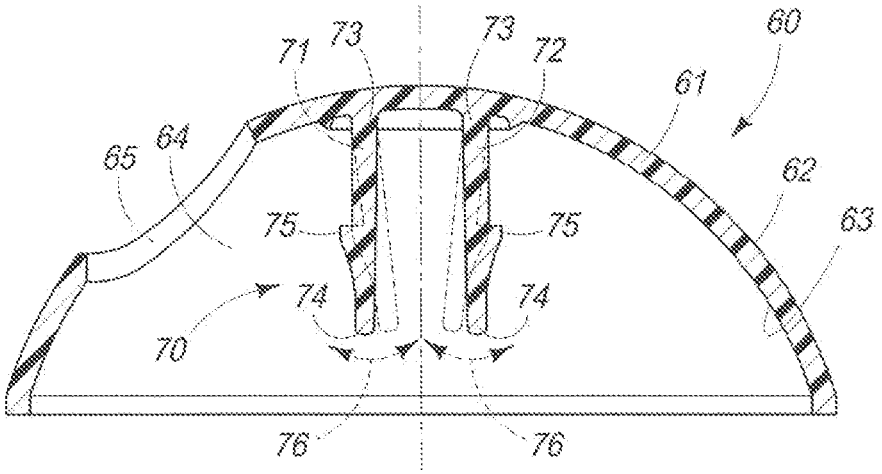
FIG. 5 is a greatly enlarged, transverse, vertical sectional view of the moveable cover which finds usefulness in the present invention.

The liquid metering assembly 10 of the present invention includes a moveable cover 60 which is matingly coupled to the container cap 30 [FIGS. 4 and 5], and which further is defined by a main body 61 having an outside facing surface 62, and an opposite, inside facing surface 63. The inside facing surface defines a semi-hemispherical shaped internal cavity 64 which is operable to matingly couple, or otherwise receive, and cover, at least in part, a portion of the top or outside facing surface 32, of the container cap 30, in the manner as will be described below. The main body 61 defines a second liquid dispensing aperture 65 [FIGS. 1 and 5] which can be adjustably positioned so as to be aligned with the first liquid dispensing aperture 34 as described in the paragraphs, above. Additionally, the moveable cover 60 includes a downwardly depending engagement member 70 which is mounted on the inside facing surface 63, and which is defined by first and second portions 71 and 72, respectively. The first and second portions each depend downwardly from the inside facing surface 63, and are spaced a given distance apart so as to be received within the centrally disposed coupling passageway 37. More specifically, the first and second portions each have a first end 73 which is attached to the inside facing surface 63, and an opposite or distal end 74. Additionally, and as seen in FIG. 4, for example, each of the first and second portions 71, and 72, include laterally outwardly facing lips or tangs positioned between the first and second end 73 and 74 thereof. The respective lips or tangs are operable to engage the peripheral edge of the downwardly depending sidewall 52 and which defines the centrally disposed coupling passageway 37. As will be recognized by a study of FIG. 5, the first and second portion 71 and 72 can be resiliently bent or otherwise deformed, inwardly, so as to allow the second end 74 of each of the first and second portions, 71 and 72, to move through the centrally disposed coupling passageway 37, and thereby allows the lips or tangs portion 75 to engage the peripheral edge of the downwardly depending sidewall 52 in a snap-fit arrangement, thereby releasably securing the moveable cover 60 in rotatable relation relative to the container cap 30. This arrangement also permits the moveable cover 60 to be easily detached from the container cap 30, so as to allow a user to easily clean both subassemblies 30 and 60, respectively, after the present invention has been used for a period of time. The moveable cover 60 is operable to move, rotate, or be selectively displaced along a rotational path of travel which is generally indicated by the numeral 76 [FIGS. 1 and 2]. The rotational path of travel is defined between a first position 77 [FIG. 1], whereby the first liquid dispensing aperture 34 is substantially aligned with the second liquid dispensing aperture 65 as seen in FIG. 3 and imagined in FIG. 1, and a second position 78 as seen in FIG. 2, and whereby the first and second liquid dispensing apertures are disposed at predetermined spaced relationship, and a portion of the main body 31, of the container cap 30, substantially occludes the second liquid dispensing aperture 65.

As seen in FIG. 4, the present invention 10 includes, as one of its features, a moveable diaphragm which is generally indicated by the numeral 90. The moveable diaphragm releasably cooperates at least in part with the container cap 30, and moveable cover 60, and is coupled in fluid flowing relation relative to the first liquid dispensing aperture 34 when assembled. The moveable diaphragm has a main body 91 which is defined by an outside facing surface 92, and an opposite, inside facing surface 93. The main body 91 has a substantially circular peripheral edge 94, and the main body 91 is dimensioned to be releasably, and sealably received within the reduced dimensioned second cavity 45, that was described, above. A downwardly extending sidewall 95 is located along, and depends downwardly from the peripheral edge 94, and further defines an internal cavity 96. The main body is fabricated from a resilient elastomeric material which can be readily deformed and easily cleaned. As best seen by reference to FIG. 4, a small flange portion 97 extends substantially, radially, outwardly, relative to the downwardly extending sidewall 95.

As seen in FIG. 4 and the other views, the moveable diaphragm 90 has a flexible liquid dispensing conduit 100 which is made integral with the outside facing surface 92 of the main body 91. The flexible liquid dispensing conduit has a first end 101 which is coupled in fluid flowing and receiving relation relative to the internal cavity 96. Further the flexible liquid dispensing conduit 100 has a second and 102, and which extends through the first and second liquid dispensing aperture 34 and 65, respectively when they are aligned, and when the moveable cover 60 is further located in the first position 77. This is best seen by reference to FIG. 1. The flexible liquid dispensing conduit 100 also defines a continuous passageway 103 extending between the first and second ends 101 and 102, respectively, and through which a fluid or beverage which was earlier deposited within the beverage container 11, may pass. Additionally, as seen in FIG. 4, an elongated slit valve member 104 is made integral with the radially extending flange portion 97 of the diaphragm. The elongated silt valve member 104 has a first end 105 which is coupled in fluid flowing relation relative to vent aperture 36, and an opposite, second end 106, which has an elongated slit 107 formed therein. The slit valve operates in a manner which is well known in the art, and allows the surrounding ambient atmosphere, to pass through the vent aperture 36, in the event that a pressure differential exists between the ambient atmosphere, and the internal cavity 24 of the beverage container 11. This typically occurs when the source of the fluid or liquid 25 is withdrawn during a drinking process. This is shown in phantom lines in FIG. 3. The slit valve 104 otherwise operates to selectively and sealably occlude the vent aperture 36 and prevents the escape of fluid 25 from the internal cavity 24 of the beverage container 11 if the beverage container is accidentally overturned. The flexible liquid dispensing conduit 100 is moveable along a path of travel 110 as best seen by reference to FIGS. 2 and 7. In this regard, it will be appreciated that when the liquid dispensing conduit 100 is located in a first position 111, it is operable to present or otherwise locate the second end 102, thereof, in an orientation where a user of the present invention may conveniently place their lips about the second end 102 and cause suction to be applied in order to withdraw the source of liquid or fluid 25 from the internal cavity 24 of the beverage container 11. However, upon completing the use of the invention, or upon finishing the drinking process, a user may conveniently grasp the main body 61 of the moveable cover 60, and then rotate it from the first position 77, as seen in FIG. 1 to the occluded, second position 78 as seen in FIG. 2. Rotation of the moveable cover along the path of travel 76 is effective in forcibly urging the flexible liquid dispensing conduit 100 to bend down, or otherwise be resiliency distorted such that it may lay conformably within or be suitably placed and be received within the semi-circular shaped cavity 38 which is formed in the top facing surface 32 of the container cap 30, and then be concealed beneath the movable cover 60. This is best seen in FIG. 2 and 7, respectively. The process of bending or otherwise urging the flexible liquid dispensing conduit 100 into the semicircular shaped cavity 38 is effective in somewhat partially occluding the passageway 103 and thereby preventing any further escape of liquid from the internal cavity 24. By reversing the rotation, the resilient flexibly liquid dispensing conduct 100 moves upwardly through the aligned first and second dispensing apertures 34, and 65 as seen in FIG. 1.

The moveable diaphragm 90 as described, above, includes an elongated valve member which is generally indicated by the numeral 120 [FIG. 4], and which further depends substantially, normally, downwardly, from the inside facing surface 93, The valve member 120 has a first end 121, which is affixed to, or made integral with, the inside facing surface 93; and an opposite second or distal end 122 which depends downwardly and into the first cavity 42. Additionally, the elongated valve member 120 has an intermediate portion 123. Made integral with or attached to the intermediate portion 123, is a radially extending valve portion 124 having a predetermined outside diametral dimension, and an engagement surface 125 which is operable to fluid sealing engage a liquid volume control member in the manner which will be discussed in greater detail, hereinafter.

Figure 8:
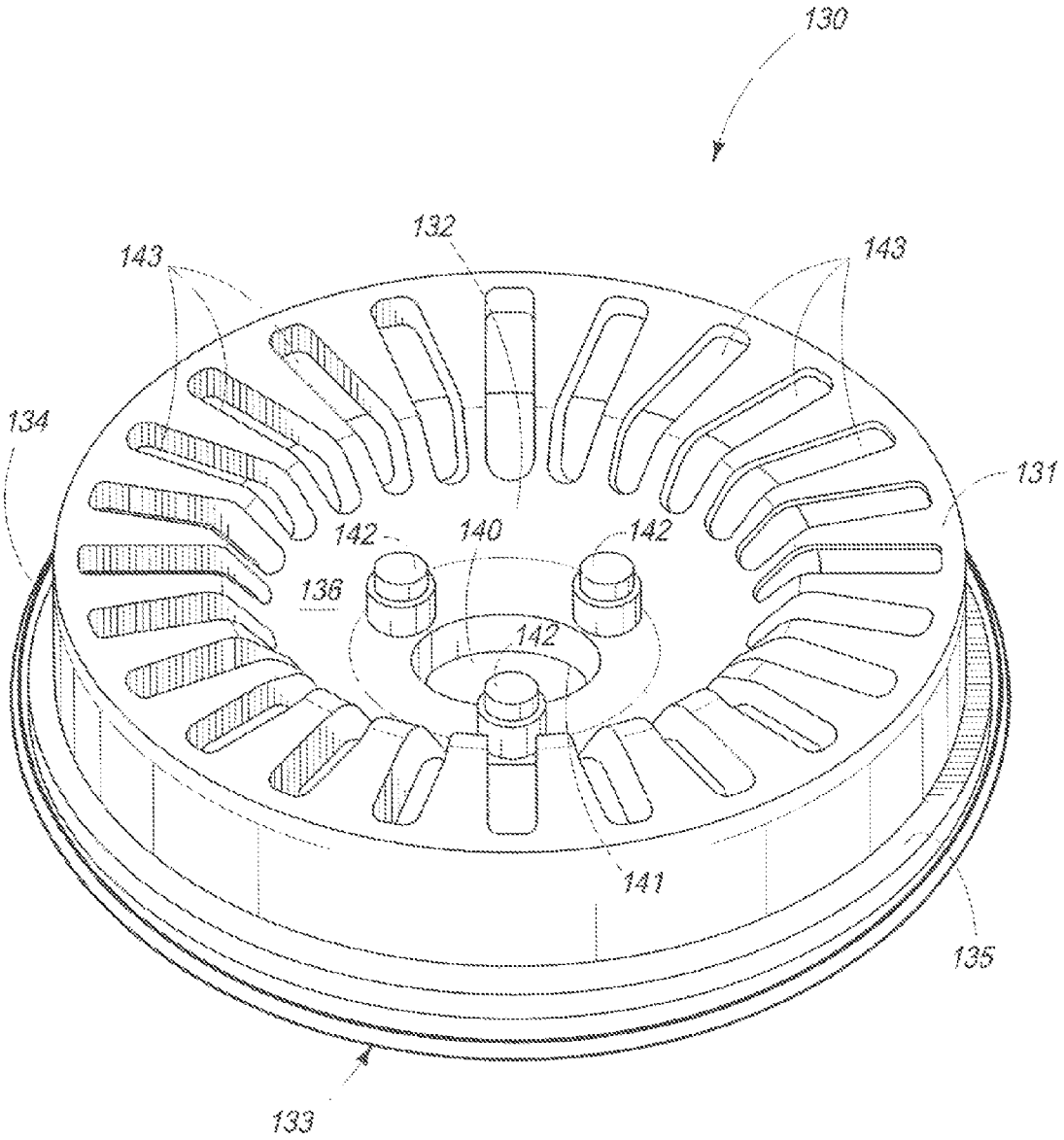
FIG. 8 is a perspective, top, plan view of a moveable liquid volume control member which forms a feature of the present invention.

The present invention further includes as one of its features, a moveable or adjustable liquid volume control member which is generally indicated by the numeral 130, and which sealably, matingly, and selectively moveably operably cooperates with the resilient and moveable diaphragm 90, and which provides a convenient means which allows a user of the invention 10 to selectively, adjustably, and easily control the volume of the source of liquid 25 which is delivered from the beverage container 11 [FIGS. 4 and 8]. This functional attribute of a drinking or other fluid dispensing container has not been possible, heretofore. The liquid volume control member 130 is defined by a main body 131, and which has an outside or top surface 132, and a bottom, or inside facing surface 133. Still further the main body is defined by a peripheral edge 134, and which further defines a seat 135 which is operable to releasably, and sealably receive, or otherwise conformably mate with, the downwardly extending sidewall 95 of the moveable diaphragm 90. Still further, the top surface 132 defines a concavely shaped, liquid receiving chamber which is generally indicated by the numeral 136.

As best illustrated in the drawings, a fluid flowing aperture 140 is formed in the main body 131, and extends between the top and bottom surfaces 132 and 133, respectively. The liquid or fluid 25 which is enclosed in the internal cavity 24 passes through the fluid flowing aperture 140 on its way to the flexible liquid dispensing conduit 100. As seen in the drawings, a frusto-connically shaped or appropriately molded seal seat 141 is formed in the main body 131, and is located near the inside facing surface 133 and which surrounds, and defines, at least in part, the fluid flowing aperture 140 which extends through the main body 131. This seal seat 141 is operable to sealably mate or otherwise cooperate with the engagement surface 125 which is defined by the valve portion 124 of the elongated valve member 120. As best seen by reference to FIG. 8, a multiplicity of movement limiting members 142 are mounted on or made integral with the top surface 132, and are located adjacent to, and surrounding the fluid flowing aperture 140. The movement limiting members 142 engage, and otherwise restrict the movement of the moveable diaphragm 90 from occluding or otherwise blocking the fluid flowing aperture 140. This feature of the invention will be discussed in greater detail, below.

Additionally, and as will be seen in FIG. 8, a multiplicity of fluid flowing channels 143 are formed in the top surface 132, and extend generally radially, outwardly, from the liquid receiving chamber 136, and towards the peripheral edge 134 thereof. The multiplicity of fluid flowing channels 143 each have variable dimensions, that is, either length, width, or depth, or combinations of these dimensions. During operation, and when properly assembled, at least one of the fluid flowing channels 143 is positioned in fluid delivering, and flowing relation relative to the first end 101 of the flexible liquid dispensing conduit 100. The respective fluid flowing channels 143 have a length dimension of, generally, about 15 mm; a width dimension of, generally, about 1.8 mm; and a depth dimension of about 0.22 mm to about 4 mm. it should be understood that the main body 131 is sealably secured in the internal cavity 96 as defined by the moveable diaphragm 90, but is selectively rotatably moveable relative thereto by a user. In view of the variable dimensions of the multiplicity of fluid flowing channels 143, a user of the present invention 10 can position or otherwise orient an appropriate fluid flowing channel 143 to provide a given volume of liquid to be delivered to the first end 101 of the flexible liquid dispensing conduit 100. In the arrangement as seen in the drawings, and in particular with respect to FIG. 3, a conduit coupler 144 is provided, and which extends downwardly from the bottom or inside facing surface 133, and which further circumscribes or surrounds the fluid flowing aperture 140. The conduit coupler has a given length dimension which allows it to be easily grasped by a user in order to facilitate or cause the rotation of the main body 131 so as to align a given fluid flowing channel 143 with the first end 101, so as to deliver the desired amount of liquid 25 to the flexible liquid dispensing conduit 100.

As illustrated in FIGS. 1 and 3, respectively, the present invention 10 further has a fluid withdrawing conduit 145 which has a proximal end 146 which is operable to be telescoping received within the conduit coupler 144. The fluid withdrawing conduit 145 further has a distal end 147 which is positioned near to, but in spaced relation relative to, the inside, bottom surface 12 of the beverage container 11. As should be appreciated, when suction is applied by a mouth of a user to the second end 102 of the flexible liquid dispensing conduit 100, air pressure within the infernal cavity 24 is reduced as the liquid 25 enters the distal end 147 of the fluid withdrawing conduit 145, and is then drawn up the fluid withdrawing conduit. The liquid then passes through the fluid flowing aperture 140 where the fluid 25 is then received in the liquid receiving chamber 136. Upon being received in the liquid receiving chamber 136, the liquid 25 would then move along one of the selected fluid flowing channels 143 and then be received in the first end 101 of the flexible liquid dispenser 100. The liquid 25 would then travel to the distal end 102 and into the mouth of the user.

As will be appreciated, the moveable diaphragm 90 of the present invention is typically fabricated from a resilient, elastomeric polymer which is flexible, and which will distort, or otherwise move under the higher outside ambient air pressure as caused by a suction force which is applied to the second end 102 of the flexible liquid dispensing conduit 100. More specifically, and when assembled, if is understood from the drawings that the moveable or adjustable liquid volume control member 130 is fluid sealingly received, and matingly couples with the moveable diaphragm 90. Further, the moveable diaphragm 90 is fluid sealingly received within the reduced dimensioned second cavity 45 which is defined by the container or drinking cap 30. When properly aligned, the flexible liquid dispensing conduit 100 is received through the first liquid dispensing aperture 34 which is defined by the container or drinking cap 30. When properly aligned, the second liquid dispensing aperture 65 permits the second end 102 of the flexible liquid dispensing conduit 100 to extend, therethrough, as best seen by reference to FIG. 1. The moveable diaphragm 90, can be moved by a pressure differential along a path of travel 150 between a first seated position 151 [FIG. 3], and wherein the valve portion 124 of the elongated valve member 120, sealably mates thereagainst the seal seat 141, and which defines a portion of the fluid flowing aperture 140. In this position, the valve member impedes, or otherwise prevents the passage of any liquid 25 from the drinking vessel 11. Simultaneously, the elongated slit valve member 104, and more specifically the second or distal end 106 thereof, prevents liquid 25 from escaping from the beverage container 11, and passing through the vent aperture 36. In this first, sealed position the air pressure of the ambient environment, and the air pressure within the infernal cavity 24 are substantially equal. In the event that a user (not shown) wishes to drink or otherwise consume or dispense the liquid 25, a suction is applied by the mouth of the user to the second end 102 of the flexible liquid dispensing conduit 100. When this condition exists, the elongated valve member 120, and more specifically the valve portion 124 is moveable to a second displaced position 152, under the influence of the higher, outside ambient air pressure in view of the vacuum or reduced air pressure created in the internal cavity 24 of the beverage container 11 by the removal of the liquid, and which is caused by the suction created by the user. As will be appreciated, the suction which is applied by the mouth of the user, not shown, causes the main body 91 to be drawn away from the inside facing surface 33 of the drinking cap 30 and towards the liquid receiving chamber 136. In this displaced orientation, fluid, 25, can then move between the valve portion 124, and into the liquid receiving chamber 136 of the liquid valve control member 130. Once the liquid 25 is received in the liquid receiving chamber 136, the liquid can then travel, along any of the previously described fluid flowing channels 143, and thereby pass out through the flexible liquid dispensing conduit 100.

As earlier described, the liquid valve control member 130 includes a multiplicity of movement limiting members 142 which prevents the main body 131 from distorting, or otherwise being displaced or oriented in a position where it might be located in an occluding or covering relationship relative, to the fluid flowing aperture 140. As the suction, as described above, is being applied by the mouth of the user, not shown, the elongated slit valve member 104, and more specifically the second or distal end 106 thereof opens to a position where it is disposed in a partially, nonoccluding position relative to the vent aperture 36 [FIG. 3]. This allows the outside ambient environment to communicate with the internal cavity 24 of the beverage container 11. This movement of the slit valve into this nonoccluding position allows the ambient atmosphere to equalize the air pressure within the beverage container 11, and thus allows for the smooth flow of the liquid 25 through the fluid withdrawing conduit 145, and into the liquid receiving chamber 136. When the suction of the person's mouth is withdrawn or stops, the elongated valve member resiliency moves back to the first seated position 151 thereby impeding any movement of the fluid 25 from the beverage container 11 in the event that the beverage container is overturned accidently. Further, the slit valve 104 returns to an occluding position relative to the vent aperture 36 thereby preventing the escape of any liquid 25 through the vent aperture 36 in the event the beverage container 11 is inadvertently overturned.

Operation

The operation of the described embodiment of the present invention is believed to be readily apparent, and is briefly summarized at this point.

In its broadest aspect, the present invention relates to a liquid metering assembly 10 and which includes a container 11 enclosing a source of a liquid 25 to be dispensed; and a container cap 30 for releasably engaging and enclosing the source of the liquid 25 within the container 11. The container 11 has a top and bottom surface 32 and 33, respectively. A cavity 38 is formed in the top surface 32, and the container cap 30 defines a first liquid dispensing aperture 34, and a vent aperture 36. In its broadest aspect the liquid metering assembly 10 includes a moveable cover 60 which is matingly coupled to the container cap 30, and which further defines a second liquid dispensing aperture 65 which can be adjustably positioned so as to be aligned with the first liquid dispensing aperture 34. The present invention includes a moveable diaphragm 90 which releasably cooperates with the container cap 30, and which also has a flexible liquid dispensing conduit 100 which extends through each of the aligned first and second liquid dispensing apertures 34 and 65, respectively, and a moveable valve member 120. The invention 10 further includes a moveable liquid volume control member 130 which sealably, and matingly cooperates with the moveable diaphragm 90, and which further defines a liquid receiving chamber 136. The flexible liquid dispensing conduit 100 is coupled in fluid flowing relation relative to the liquid receiving chamber 136. The moveable liquid volume control member 130 has a fluid flowing aperture 140 formed therein. The valve member 120 of the moveable diaphragm 90 is received in the fluid flowing aperture 140, and is moveable relative, thereto, when a suction is applied to the flexible liquid dispensing conduit 100. A selective movement of the liquid volume control member 130 relative to the moveable diaphragm 90 varies the volume of the liquid 25 which is dispensed from the container 11, when a given amount of suction is applied to the flexible liquid dispensing conduit 100.

More specifically the present invention relates to a liquid metering assembly 10 which includes a container 11 for enclosing a source of a liquid 25 to be dispensed, and wherein the container 11 defines an internal cavity 24 for enclosing the liquid 25, and further has a neck portion 15 which communicates with the internal cavity 24. The invention further includes a container cap 30 for releasably engaging with the neck portion 15 of the container 11, and which further has a top surface 32 which defines, at least in part, a semicircular shaped cavity 38, and further has a bottom surface 33. The top surface 32 further has formed therein a centrally disposed coupling passageway 37 which extends therethrough; a vent aperture 36; and a first liquid dispensing aperture 34 which communicates with the semicircular shaped cavity 38 which is formed in the top surface 32 of the container cap 30. The bottom surface 33 of the container cap 30 defines a first cavity 42 which releasably and matingly receives and cooperates with the neck 15 of the container 11, and further defines a reduced dimensioned second cavity 45 which is defined by a downwardly depending sidewall 46 which is mounted on the bottom surface 33 of the container cap 30. The first liquid dispensing aperture 34 communicates with the second cavity 45, and the vent aperture 36 communicates with the first cavity 42 when the invention is assembled. A moveable cover 60 having top and bottom surfaces 61 and 62, respectively, and which is conformably shaped to matingly and rotatably cooperate with the container cap 30, is provided. The moveable cover 60 further has a second, liquid dispensing aperture 65 which is formed therein, and which is further moveable along a given course of travel 76 between a first and second position 77 and 78, respectively. The moveable cover 60 has an engagement member 70 which is mounted on the bottom surface 63, thereof, and which is dimensioned to be operably received within the coupling passageway 37, and which further renders the moveable cover 60 rotatable relative to the container cap 30. A moveable diaphragm 90 is provided which is mounted, at least in part, within the second cavity 45 of the container cap 30. The moveable diaphragm 90 defines an internal cavity 96, and further includes a moveable valve member 120 which is mounted on the diaphragm 90, and which further depends, downwardly, therefrom. A flexible liquid dispensing conduit 100 is made integral with the moveable diaphragm 90, and further has a first end 101 which communicates in fluid receiving relation relative to the internal cavity 96 of the moveable diaphragm 90, and a second end 102. The flexible liquid dispensing conduit 100 extends through the first and second liquid dispensing apertures 34 and 65 respectively, when they are aligned, and the moveable cover 60 is in the first position 77. A moveable liquid volume control member 130 is provided, and which sealably and matingly cooperates with the moveable diaphragm 90, and is further received, at least in part, within the internal cavity 96, thereof. The moveable liquid volume control member further defines a liquid receiving chamber 136 which has a fluid flowing aperture 140 formed therein, and a multiplicity of fluid flowing channels 143 which have different dimensions. The first end 101 of the flexible liquid dispensing conduit 100 is coupled in fluid receiving relation relative to the liquid receiving chamber 136. The valve member 120 is operably received within the fluid flowing aperture 140 which is defined by the liquid volume control member 130, and is further reciprocally moveable relative thereto from a first occluding position 151, to a second displaced and fluid flowing position 152. The movement to the second nonoccluding position 152 is effected by the application of a suction force which is imparted to the second end 102 of the flexible liquid dispensing conduit 100 by means of a mouth a person, and which then permits the source of the liquid 25 in the container to pass into the liquid receiving chamber 136, and then be received in the flexible liquid dispensing conduit 100.

In the present invention a liquid metering assembly 10 is described and where the flexible liquid dispensing conduit 100 has a fluid passageway 103 formed therein, and which further extends between the first and second ends 101 and 102 thereof. The movement of the cover 60 from the first position 77, to the second position 78, is effective in bending the flexible liquid dispensing conduit 100 so as to at least, in part, partially occlude the fluid passageway 103, and which simultaneously urges the flexible liquid dispensing conduit 100 into conformable mating relation and receipt within the semicircular shaped cavity 38, which is formed in the top surface 32, of the container cap 30, and under the movable cover into a concealed location, as seen in FIG. 2. The liquid meter assembly 10, and more specifically the movable cover 60, when located in the first position 77, is effective in causing the first and second liquid dispensing apertures 34 and 45, respectively, to be substantially aligned; and when located in the second position 78, the first and second liquid dispensing apertures 34 and 45 are misaligned, and disposed in laterally spaced relation, one relative to the other.

The liquid metering assembly of the present invention 10 further includes a movable diaphragm, and which further has a slit valve 104, which selectively occludes the vent aperture 76 when the liquid metering assembly 10 is not in operation, and further is located in a non-occluding position when the liquid metering assembly is in operation, and further couples the surrounding, ambient environment with the internal cavity 24 of the beverage container 11. The movable valve member 120, as provided by the diaphragm, has a distal end 122 and an intermediate region 123, having a valve portion 124, which movably and matingly cooperates with the fluid flowing aperture of 140, which is defined by the movable liquid volume control member 130. Suction applied by the mouth of a person employing the invention causes the main body 91 of the diaphragm 90 to move downwardly under the influence of higher outside ambient air pressure, and towards the movable liquid volume control member 130. The movement of the diaphragm 90 towards the liquid volume member 130 has the overall effect of moving the valve portion 124 into a spaced, displaced and non-occluding position 152 relative to the fluid flowing aperture 140. The removal of the suction by the person employing the invention causes the diaphragm 90 to move away from the liquid volume control member 130 as the air pressure equalizes, and thereby causes the valve portion 124 to move upwardly, and into a substantially occluding position 151 relative to the fluid flowing aperture 140. As earlier discussed, the respective fluid flowing channels 143 which are formed in the liquid volume control member 130, have variable dimensions. Further, the selective positioning of the liquid volume control member 130 relative to the movable diaphragm 90 is effective in varying the volume of the source of the liquid 25, which is delivered from the internal cavity 24 of the container 11 to the first end 101, of the flexible liquid dispensing conduit 100. As will be readily seen in the drawings, the respective fluid flowing channels 143, which are individually defined by the liquid volume control member 130, each have a width dimension of about 1.8 millimeters; a length dimension of about 15 millimeters; and a depth dimension of about 0.2 millimeters to about 4.0 millimeters. Again, the selective rotation or movement of the movable or adjustable liquid volume control member 130 allows a user to set, or predetermine, in advance, the amount, and volume, of the liquid 25, which may reach the flexible liquid dispensing conduit 100, With this novel arrangement, a user can, for example, adjust the volume of the liquid dispensed so as to allow them to train an infant or child, for example, to drink properly as their eating and swallowing reflexes and skills develop.

In the arrangement as seen in the drawings, it will be understood that the present invention, which is described, is easily disassembled, and cleansed, and then reassembled by a user. Upon reassembly, it will be understood that the second or distal end 122 of the valve member 120 is first pushed through the fluid flowing aperture 140, from the liquid receiving chamber side 136, and then is grasped by the fingers of the user and pulled downwardly thereby causing the intermediate portion 123, bearing the valve portion 124, to be distorted and squeezed through the fluid flowing aperture 140, and into the first seated position 151. Still further, the movable cover 60 is easily detached from the container cap 30 pressing the first and second portions 71 and 72, in an inward direction, thus allowing the engagement member 70 to be removed from the centrally disposed coupling passageway 37, which is formed by the container cap. Assembly of the moveable cover back into rotating engagement with the container cap 30 is a reverse operation. It should be understood that the diaphragm 90, and more specifically the flexible liquid dispensing conduit 100, is appropriately oriented so as to extend through the first liquid dispensing aperture 34, and the second liquid dispensing aperture 45. Further, the diaphragm 90 is then received within the reduced dimensioned second cavity 45, once the movable or adjustable liquid volume control member 130 is received within the internal cavity 96 of the movable diaphragm 90.

Therefore, it will be seen that the prevent invention provides a convenient and novel means by which a user can conveniently adjust the flow of a liquid 25 from a beverage container 11 in a manner not possible, heretofore. Further, the prevent invention 10 provides a novel means for sealing a drinking vessel 11 so as to prohibit the accidental spilling of a liquid 25 which is occasioned when by the drinking vessel is accidentally overturned.

In compliance with the statute, the present invention has been described, in language more or less specific as to structural and methodical features. It is to be understood, however, that the invention is not limited to the specific features shown and described since the means herein disclosed comprise preferred forms of bringing the invention into effect. The invention is, therefore, claimed in any of its forms and modifications within the proper scope of the appended claims, appropriately interpreted in accordance with the Doctrine of Equivalence.

I claim:

1. A liquid metering assembly, comprising;

a container enclosing a source of a liquid to be dispensed;

a container cap for releasably engaging, and enclosing, the source of the liquid within the container, and wherein the container has a top surface and a bottom surface, and wherein a cavity is formed in the top surface, and the container cap defines a first liquid dispensing aperture, and a vent aperture;

a moveable cover which is matingly coupled to the container cap, and which defines a second liquid dispensing aperture which can be adjustably positioned so as to be selectively aligned with the first liquid dispensing aperture;

a moveable diaphragm releasably cooperating with the container cap, and which has a flexible liquid dispensing conduit which extends through each of the aligned first, and second liquid dispensing apertures, and a moveable valve member; and a moveable liquid volume control member which sealably, and matingly cooperates with the moveable diaphragm, and which further defines a liquid receiving chamber, and wherein the flexible liquid dispensing conduit is coupled in fluid flowing relation relative to the liquid receiving chamber, and wherein the moveable liquid volume control member has a fluid flowing aperture formed therein, and wherein the valve member of the moveable diaphragm is received in the fluid flowing aperture, and is moveable relative thereto when a suction is applied to the flexible liquid dispensing conduit, and wherein a selective movement of the liquid volume control member relative to the moveable diaphragm varies a volume of the liquid which is dispensed from the container when a given amount of suction is applied to the flexible liquid dispensing conduit.

2. A liquid metering assembly as claimed in claim 1, and wherein the flexible liquid dispensing conduit defines a fluid passageway extending therethrough, and wherein the flexible, liquid dispensing conduit has a first end coupled in fluid flowing relation relative to the diaphragm, and a second end upon which a person may draw upon with their mouth so as to create the suction which causes a movement of the moveable diaphragm relative to the fluid flowing aperture, and wherein the movement of the moveable cover so as to misalign the first and second liquid dispensing apertures is effective in bending the flexible, liquid dispensing conduit so as to occlude, at least in part, the fluid passageway, and prevent the dispensing of any liquid from the container.

3. A liquid metering assembly as claimed in claim 2, and wherein the moveable cover may be moved along a course of travel from a first position, wherein the first and second liquid dispensing apertures are substantially aligned, and which further permits the flexible liquid dispensing conduit to assume an orientation where the fluid passageway is substantially non-occluded, to a second position, and wherein, in the second position, the first and second liquid dispensing apertures are misaligned, and located in spaced relation, one relative to the other, and which causes the flexible liquid dispensing conduit to be moved into the cavity formed in the top surface of the container cap, and underneath the moveable cover.

4. A liquid metering assembly as claimed in claim 3, and wherein the container is a beverage container, and the source of the liquid to be dispensed is a liquid which can be consumed by the person who is drawing with their mouth upon the second end of the flexible, liquid dispensing conduit to create a vacuum, and wherein the movement of the container cap from the second position, to the first position causes the flexible liquid dispensing conduit to move from the cavity formed in top surface of the container cap, and through the second liquid dispensing aperture so that the second end, thereof, my be easily accessed by the mouth of the person.

5. A liquid metering assembly as claimed in claim 4, and wherein the bottom surface of the container cap defines a first cavity which releasably, and matingly cooperates with the beverage container, and further defines a reduced dimensioned, second cavity, and wherein the second cavity is defined, at least in part, by a downwardly depending sidewall which is mounted on the bottom surface of the container cap, and wherein the first end of the flexible, liquid dispensing conduit communicates with the second cavity, and the vent aperture communicates in fluid flowing relation relative to the first cavity.

6. A liquid metering assembly as claimed in claim 5, and wherein the moveable diaphragm further includes a moveable flap which selectively occludes the vent aperture when the liquid metering assembly is in operation.

7. A liquid metering assembly as claimed in claim 5, and wherein the moveable diaphragm further includes a slit valve which selectively occludes the vent aperture when the liquid metering assembly is in operation.

8. A liquid metering assembly as claimed in claim 5, and wherein the container cap defines a generally centrally disposed coupling passageway, and the moveable cover has an elongated engagement member extending downwardly therefrom, and which is matingly received within the coupling passageway, and wherein the moveable cover rotates about the elongated engagement member, and in at least partially, covering relation relative to the container cap, and wherein the moveable diaphragm is fluid sealably received, at least in part, within the second cavity.

9. A liquid metering assembly as claimed in claim 8, and wherein the valve member is elongated in shape, and further extends normally, downwardly from an inside facing surface of the moveable diaphragm, and wherein the elongated valve member has a distal end, and an intermediate portion, and wherein a valve portion is made integral with the elongated valve member, and is located on the intermediate portion, and wherein the movement of the diaphragm in a given, downward direction, and under the influence of the suction applied by the mouth of the person is effective in displacing the valve portion from an occluding position relative to the fluid flowing aperture which is formed in the moveable liquid volume control member, and wherein the release of the suction provided by the person is effective in permitting the valve portion to move upwardly, and back into a substantially occluding position relative to the fluid flowing aperture.

10. A liquid metering assembly as claimed in claim 9, and wherein the liquid volume control member has a main body defined by a peripheral edge, and top and bottom surfaces, and wherein the top surface defines a liquid receiving chamber, and wherein the fluid flowing aperture is formed in the main body thereof, and extends therethrough, and wherein a multiplicity of fluid flowing channels are formed in the top surface, and further extend radially outwardly from the liquid receiving chamber, and towards the peripheral edge, and wherein at least some of the fluid flowing channels of the liquid volume control member have variable dimensions, and wherein at least one of the fluid flowing channels is positioned in fluid delivering relation relative to the first end of the flexible liquid dispensing conduit, and wherein the main body of the liquid volume control member can be selectively and sealably rotated relative to the moveable diaphragm so as to allow for the dispensing of an adjustable volume of the source of the liquid from the beverage container to the flexible liquid dispensing conduit, and wherein the top surface of the liquid control member is received, at least in part, within an internal cavity which is defined by the moveable diaphragm, and wherein the top surface of the liquid volume control member defines at least one movement limiting member which limits the motion of the moveable diaphragm relative to the top surface of the moveable liquid volume control member, and under the influence of the suction which is applied by the mouth of the person, to the second end of the flexible liquid dispensing conduit.

11. A liquid metering assembly as claimed in claim 10, and wherein the fluid flowing channels of the liquid volume control member each have a width dimension of less than about 1.8 mm; a length dimension of about less than about 15 mm; and a depth dimension of about 0.2 mm. to about 4 mm.

12. A liquid metering assembly as claimed in claim 11, and wherein the cavity formed in the top surface of the container cap is elongated, and has a length, width and depth dimension which permits the cavity to receive the flexible fluid dispensing conduit therein.

13. A liquid metering assembly as claimed in claim 12, and wherein the flexible liquid dispensing conduit is received and concealed with the cavity which is formed in the top surface of the container cap when the container cap is located in the second position.

14. A liquid metering assembly, comprising:

a container for enclosing a source of a liquid to be dispensed, and wherein the container defines an internal cavity for enclosing the liquid, and further has a neck portion which communicates with the internal cavity;

a container cap for releasably engaging the neck portion of the container, and which further has a top surface which defines, at least in part, a semi-circular shaped cavity, and a bottom surface, and wherein the top surface further has formed therein a centrally disposed coupling passageway which extends therethrough, a vent aperture, and a first, liquid dispensing aperture which communicates with the semi-circular shaped cavity formed in the top surface of the container cap, and wherein the bottom surface of the container cap defines a first cavity which releasably and matingly receives and cooperates with the neck of the container, and further defines a reduced dimensioned, second cavity which is defined by a downwardly depending sidewall which is mounted on the bottom surface of the container cap, and wherein the first liquid dispensing aperture communicates with the second cavity, and the vent aperture communicates with the first cavity;

a moveable cover having top and bottom surfaces, and which is conformably shaped to matingly and rotatably cooperate with the container cap, and wherein the moveable cover further has a second liquid dispensing aperture formed therein, and which is further moveable along a given course of travel between a first position and a second position, and wherein the moveable cover has an engagement member mounted on the bottom surface thereof, and which is dimensioned to be operably received within the coupling passageway, and which renders the moveable cover rotatable relative to the container cap;

a moveable diaphragm mounted, at least in part, within the second cavity of the container cap, and wherein the moveable diaphragm defines an internal cavity, and further includes a moveable valve member which is mounted on the diaphragm, and which further depends downwardly therefrom; a flexible liquid dispensing conduit made integral with the moveable diaphragm, and having a first end which communicates in fluid receiving relation relative to the internal cavity of the moveable diaphragm, and a second end, and wherein the flexible liquid dispensing conduit extends through the first and second liquid dispensing apertures, when they are aligned, and the moveable cover is in the first position; and a moveable liquid volume control member which sealably, and matingly cooperates with the moveable diaphragm, and is received, at least in part, within the internal cavity thereof, and which further defines a liquid receiving chamber which has a fluid flowing aperture formed therein, and a multiplicity of fluid flowing channels which have different dimensions, and wherein the first end of the flexible liquid dispensing conduit is coupled in fluid receiving relation relative to the liquid receiving chamber, and wherein the valve member is operably received within the fluid flowing aperture defined by the liquid volume control member, and is further moveable relative thereto from a first occluding position, to a second, displaced, and fluid flowing position, and wherein movement to the second non-occluding position is effected by the application of a suction force which is imparted to the second end of the flexible liquid dispensing conduit by means of a mouth of a person, and which then permits the source of the liquid in the container to pass into the liquid receiving chamber, and then be received in the flexible liquid dispensing conduit.

15. A liquid metering assembly as claimed in claim 14, and wherein the flexible liquid dispensing conduit has a fluid passageway formed therein, and which extends between the first and second ends thereof, and wherein movement of the cover from the first position, to the second position, is effective in bending the flexible liquid dispensing conduit so as to at least, in part, partially occlude the fluid passageway, and which simultaneously urges the flexible liquid dispensing conduit into the semi-circular shaped cavity formed in the top surface of the container cap, and under the moveable cover, and into a concealed location.

16. A liquid metering assembly as claimed in claim 15, and wherein the moveable cover, when located in the first position is effective in causing the first and second liquid dispensing apertures to be substantially aligned, and when located in the second position, the first and second liquid dispensing apertures are misaligned and disposed in laterally spaced relation, one relative to the other.

17. A liquid metering assembly as claimed in claim 16, and wherein the moveable diaphragm further includes a second valve which selectively occludes the vent aperture when the liquid metering assembly is in operation, and further is located in a non-occluding position when the liquid metering assembly is in operation.

18. A liquid metering assembly as claimed in claim 17, and wherein the moveable valve member has a distal end, and an intermediate region having a valve portion which cooperates with the fluid flowing aperture which is defined by the moveable liquid volume control member, and wherein the suction applied by the mouth of the person causes the diaphragm to move downwardly, and towards the moveable liquid volume control member, and wherein the movement of the diaphragm towards the liquid volume control member moves the valve portion into a displaced, non-occluding position relative the fluid flowing aperture, and wherein the removal of the suction causes the diaphragm to move away from the liquid volume control, and thereby causes the valve portion to move into a substantially occluding position relative to the fluid flowing aperture.

19. A liquid metering assembly as claimed in claim 18, and wherein the respective fluid flowing channels formed in the liquid volume control member have variable dimensions, and wherein the selective positioning of the liquid volume control member relative to the moveable diaphragm is effective in varying the volume of the source of the liquid delivered from the internal cavity of the container, to the first end of the flexible liquid dispensing conduit.

20. A liquid metering assembly as claimed in claim 19, and wherein the fluid flowing channels which are defined by the liquid volume control member each have a width dimension of about 1.8 mm; a length dimension of about 15 mm; and a depth dimension of about 0.2 mm, to about 4.0 mm.

* * * * *